US005746329A

United States Patent [19]

Rondeau

[11] Patent Number: 5,746,329

[45] Date of Patent: May 5, 1998

[54] HANGER SYSTEM

[75] Inventor: Charles J. Rondeau, Lake Charles, La.

[73] Assignee: Northrop Grumman Corporation, Los Angeles, Calif.

[21] Appl. No.: 520,664

[22] Filed: Aug. 28, 1995

[51] Int. Cl.[6] ..... A47F 5/00

[52] U.S. Cl. ..... 211/123; 211/86; 211/DIG. 1; 248/206.5

[58] Field of Search ..... 211/123, 86, 182, 211/204, 206, DIG. 1; 248/206.5, 200.1

[56] References Cited

U.S. PATENT DOCUMENTS

| | | | |
|---|---|---|---|
| 1,859,945 | 5/1932 | Whitney | 211/123 |
| 2,177,905 | 10/1939 | McKeehan | 211/DIG. 1 X |
| 2,483,031 | 9/1949 | Avedon | 211/DIG. 1 X |
| 2,659,169 | 11/1953 | Brennan | 211/DIG. 1 X |
| 3,355,031 | 11/1967 | Kleehammer | 211/123 |
| 3,424,314 | 1/1969 | Cornelsen | 211/123 X |
| 3,481,483 | 12/1969 | Harvey et al. | 211/123 X |
| 4,058,335 | 11/1977 | Abe | 248/206.5 X |
| 4,586,616 | 5/1986 | Cooper et al. | 211/DIG. 1 X |
| 4,609,173 | 9/1986 | Belokin | 248/225.1 |
| 4,953,714 | 9/1990 | Paul | 211/DIG. 1 X |
| 4,979,625 | 12/1990 | Johnson et al. | 211/13 |

FOREIGN PATENT DOCUMENTS

| | | | |
|---|---|---|---|
| 203395 | 5/1959 | Austria | 211/DIG. 1 |

*Primary Examiner*—Robert W. Gibson, Jr.

*Attorney, Agent, or Firm*—Terry J. Anderson; Karl J. Hoch, Jr.

[57] ABSTRACT

A hanger device is provided for harmless removable attachment to sheet material. It includes a hook member for releasably suspending an article, a magnetic base member integral with the hook member and engageable with one surface of the sheet material, and a ferrous backing member engageable with an opposite surface of the sheet material and generally coextensive with the base member. In this manner, the base member and the backing member are drawn together by the magnetic flux and held firmly but removably in engagement with the sheet material. In one embodiment, the base member remains substantially fixed relative to the backing member. In another embodiment, the base member is easily rotatable relative to the backing member. In still another embodiment, the base member includes a sheet of flexible magnetized plastic material having a mounting surface engageable with the sheet material and an opposite passive surface to which a boss element integral with the hook member is bonded. In yet another embodiment, a spaced apart pair of the hanger devices are provided with a substantially level hanger rod, which may be of a telescoping type, extending between eyelets engageable, respectively, with the hanger devices.

8 Claims, 1 Drawing Sheet

HANGER SYSTEM

BACKGROUND OF THE INVENTION

I. Field of the Invention

The present invention relates generally to a hanger system for harmless removable attachment to sheet material and, more particularly, to such a system which utilizes one or more hanger devices which can be removably attached to the sheet material without being required to pierce the sheet material or bond to the sheet material or otherwise deform the sheet material.

II. Description of the Prior Art

It has long been known to provide hooks, support rods, or the like which are attachable to flexible sheet material.

Such material may include, by way of example, sheets, blankets, tarpaulins, tents, awnings, curtains or drapes, and the like; it may be plastic, such as polyvinyl chloride, either solid or perforated; it may be woven, non-woven, knitted, or even braided. Such hooks, support rods, or the like may serve to hang or suspend the sheet material itself or such expedients may be used to enable some other article or articles to be hung or suspended from the sheet material.

Known hanger devices and systems have tended to be of the type which either pierced the sheet material or were bonded to the sheet material or otherwise deformed the sheet material. While they were generally satisfactory in their performance, they would often leave unsightly holes, tears, creases and the like in the sheet material upon their removal. This would require, in turn, either repair or disposal of the sheet material, often at substantial expense.

It was in light of this state of the prior art that the present invention was conceived and has now been reduced to practice.

SUMMARY OF THE INVENTION

According to the invention, a hanger device is provided for harmless removable attachment to sheet material. It includes a hook member for releasably suspending an article, a magnetic base member integral with the hook member and engageable with one surface of the sheet material, and a ferrous backing member engageable with an opposite surface of the sheet material and generally coextensive with the base member. In this manner, the base member and the backing member are drawn together by the magnetic flux and held firmly but removably in engagement with the sheet material. In one embodiment, the base member remains substantially fixed relative to the backing member. In another embodiment, the base member is easily rotatable relative to the backing member. In still another embodiment, the base member includes a sheet of flexible magnetized plastic material having a mounting surface engageable with the sheet material and an opposite passive surface to which a boss element integral with the hook member is bonded. In yet another embodiment, a spaced apart pair of the hanger devices are provided with a substantially level hanger rod, which may be of a telescoping type, extending between eyelets engageable, respectively, with the hanger devices.

The system and device of the invention can be used, for example, in any tent or awning to provide hooks or hanging rods where holes in the fabric are unwanted.

Advantageously, the system and device of the invention may be made in various strength sizes for various material types or thicknesses. It can be readily installed or removed and does not require glue or any penetration into the supporting fabric. Nor is the invention affected by water or sun and will not change its characteristics as a result of weather conditions. The invention may be easily adapted to accept other accessories such as holders, shelves, or rods.

The magnetic hook system of the invention may be used to allow access for hanging items in fabric structures or screen material, whether metallic or non-metallic, using either a one-pole or a two-pole magnetic construction. Other uses of the invention may reside in tents, tarpaulins, and screen enclosures.

Features of the invention include its portability, weather resistance, light weight, and use of existing low-cost materials. When applied to tents, the invention can be used to add tie-downs to either the inside or outside of the structure, and may even be used to seal a hole in an emergency.

Other and further features, advantages will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention and, together with the description, serve to explain the principles of the invention in general terms. Like numerals refer to like parts throughout the disclosure.

DETAILED DESCRIPTION OF THE DRAWINGS

Figure 1:
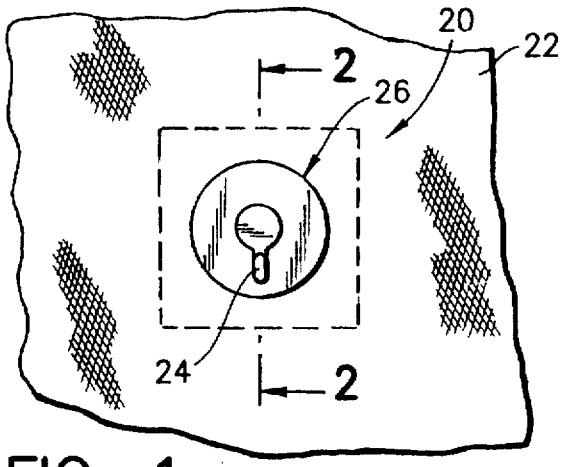
FIG. 1 is a detail front elevation view of a hanger device embodying the present invention.
Figure 2:
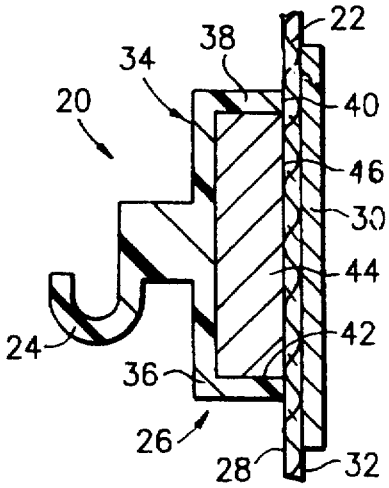
FIG. 2 is a cross section view taken generally along line 2—2 in FIG. 1.

Turn now the drawings and, initially, to FIGS. 1 and 2 which illustrate a hanger device 20 for harmless removable attachment to sheet material 22 of any known kind including, for example, sheets, blankets, tarpaulins, tents, awnings, curtains or drapes, and the like. As previously noted, the sheet material may be plastic, such a polyvinyl chloride, either solid or perforated; it may be woven, non-woven, knitted, or even braided.

The hanger device 20 includes a hook member 24 for releasably suspending an article in known fashion. A magnetic base member 26 is integral with the hook member 24 and is engageable with a first surface 28 (FIG. 3) of the sheet material 22. A ferrous backing member 30 is engageable with a second surface 32 of the sheet material 22 opposite the first surface 28 and generally coextensive with the base member 26.

The base member 26 includes a support plate 34 having a peripheral region 36 and a continuous annular flange 38 extending transversely of the support plate at the peripheral region to a rim 40 distant from the support plate. The support plate and the annular flange together define a mounting cavity 42. A magnet 44 is received in the mounting cavity and fixed as by adhesive to either the support plate 34 or to the annular flange 38, or both. The magnet has an exposed surface 46 proximate to the first surface 28 of the sheet material 22 when the base member is in engagement with the sheet material.

By reason of this construction, the base member 26 and the backing member 30 are drawn together by the magnetic flux and held firmly but removably in engagement with the sheet material 22.

It will be appreciated that although the base member 26 is described and illustrated as being circular, or cylindrical, its shape need not be so restricted. For example, as viewed in FIG. 1, it may be square, rectangular, or polygonal without affecting its operability in accordance with the invention. Also, the ferrous backing member 30 may even be a magnet itself positioned for opposite polarity with respect to the magnet 44 for yet firmer engagement with the sheet material 22.

Figure 3:
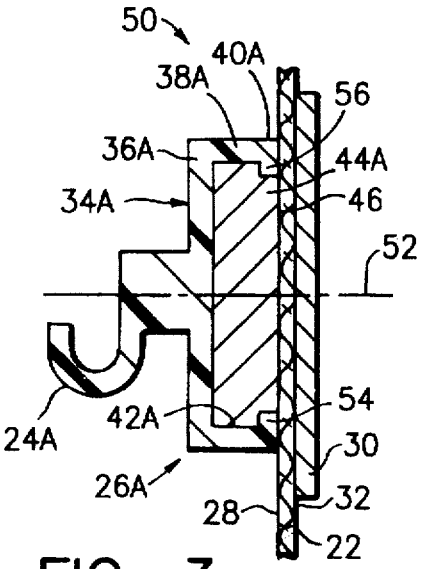
FIG. 3 is a cross section view, similar to FIG. 2, illustrating another embodiment of the invention.

Another embodiment of the invention is represented by a hanger device 50 as seen in FIG. 3. In this modified instance, a hook member is indicated by reference numeral 24A and a modified base member by reference numeral 26A. The base member 26A includes a support plate 34A having a peripheral region 36A and a continuous annular flange 38A extending transversely of the support plate at the peripheral region to a rim 40A distant from the support plate. As in the prior described embodiment, the support plate and the annular flange together define a cylindrical mounting cavity 42A therein and the mounting cavity has a central axis 52.

A peripheral flange 54 is integral with the annular flange 38A and extends inwardly toward the central axis 52 of the mounting cavity and lies in a plane generally parallel to and spaced from the support plate 34A. A magnet 44A is slidably received in the mounting cavity 42A and has an exposed surface 46 proximate to the first surface 28 of the sheet material 22 when the base member is engaged with the sheet material. The magnet 44A has a peripheral recess 56 which is matingly slidably engaged with the peripheral flange 54 and the magnet is rotatable relative to the base member 26A about a magnet axis (not separately shown) which is aligned with the central axis 52. It will be appreciated that the pliability of the annular flange 38A relative to the support plate 34A enables the selective insertion of the magnet 44A into the cavity 42A and its removal therefrom.

Figure 4:
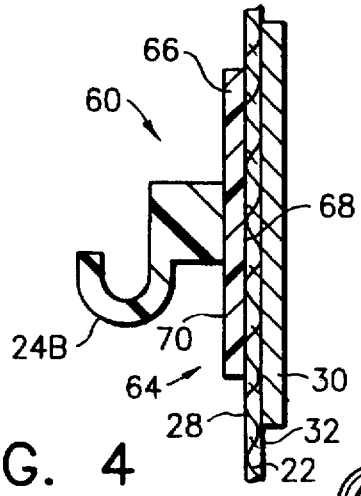
FIG. 4 is a is a cross section view, similar to FIG. 2, illustrating still another embodiment of the invention.

Still another embodiment of the invention is represented by a hanger device 60 as seen in FIG. 4. In this modified instance, a hook member 24B is integral with a boss member 62. A modified base member 64 includes a sheet 66 of flexible magnetized plastic material having a mounting surface 68 engageable with the first surface 28 of the sheet material and a passive surface 70 opposite the mounting surface. The hook member 24B is suitably bonded to the passive surface 70 of the base member.

Figure 5:
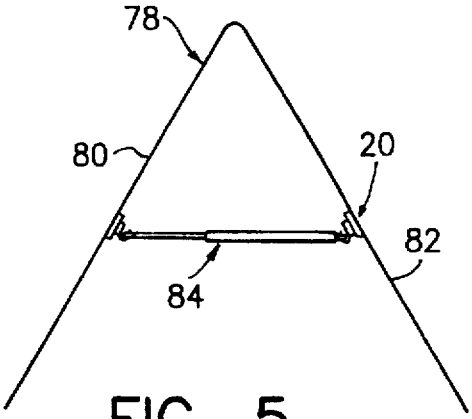
FIG. 5 is a diagrammatic side elevation view, in section, of a hanger system embodying the invention, utilizing any of the hanger devices illustrated in FIGS. 2, 3, or 4.
Figure 6:
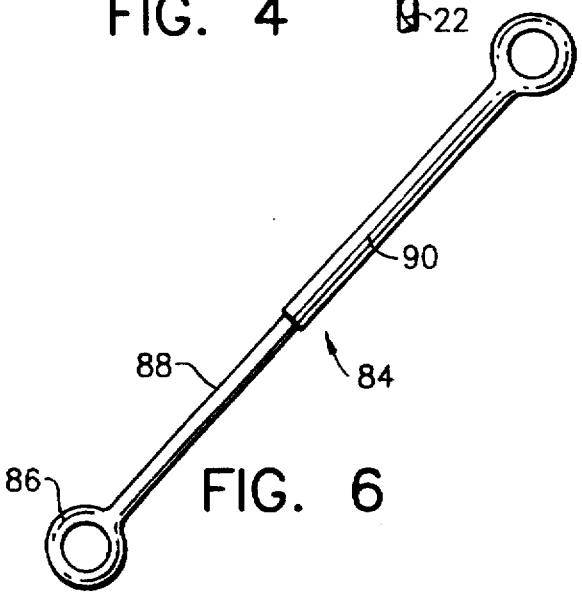
FIG. 6 is a detail side elevation view illustrating a component of the hanger system illustrated in FIG. 5.

Yet another embodiment of the invention is illustrated in FIGS. 5 and 6. In this instance, a hanger system 76 is provided for harmless removable attachment to sheet material depicted in the form, for example, of a tent 78 having opposed sides 80, 82. A spaced apart pair of the hanger devices 20 are removably attached to the sides 80, 82 in the manner previously described. A substantially level hanger rod 84 extends between eyelets at its opposite ends, respectively, which are engageable with the hanger devices 20 and is thereby releasably supported on the tent sides. In this manner, the hanger rod provides an elongated surface for suspending articles on or from the tent sides.

It may be desirable for the hanger rod 84 to include first and second rod elements, 88, 90 in slidable telescoping engagement such that one of the eyelets is integral with a free end of each of the rod elements. In this way, the spacing between the hanger devices is adjustable according to the use being sought. It will also be understood that while FIG. 5 is illustrated with spaced hanger devices 20, any of the other embodiments of hanger devices described, specifically, devices 50 and 60, may be successfully employed in this context as well.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A hanger device for harmless removable attachment to flexible sheet material having first and second opposed surfaces comprising:

a hook member for releasably suspending an article;

a magnetic base member integral with said hook member and engageable with the first surface of the flexible sheet material; and a ferrous backing member engageable with the second surface of the sheet material and generally coextensive with said base member;

whereby said base member and said backing member are drawn together by the magnetic flux and held firmly but removably in engagement with the sheet material in a sandwiched relationship.

2. A hanger device as set forth in claim 1 wherein said base member includes:

a support plate having a peripheral region;

a continuous annular flange extending transversely of said support plate at said peripheral region to a rim distant from said support plate, said support plate and said annular flange together defining a mounting cavity therein;

a magnet received in the mounting cavity and fixed to at least one of said support plate and said annular flange and having an exposed surface proximate to the first surface of the sheet material when said base member is engaged therewith.

3. A hanger device as set forth in claim 1 wherein said base member includes:

a support plate having a peripheral region; a continuous annular flange extending transversely of said support plate at said peripheral region to a rim distant from said support plate, said support plate and said annular flange together defining a cylindrical mounting cavity therein having a central axis;

a peripheral flange integral with said annular flange extending inwardly toward the central axis of the mounting cavity and lying in a plane generally parallel to and spaced from said support plate; and a magnet slidably received in the mounting cavity and having an exposed surface proximate to the first surface of the sheet material when said base member is engaged therewith, said magnet having a peripheral recess slidably engaged with said peripheral flange and rotatable relative to said base member about a magnet axis which is aligned with the central axis;

whereby said base member is selectively rotatable relative to said magnet about the central axis.

4. A hanger device as set forth in claim 1 wherein said base member includes:

a sheet of flexible magnetized plastic material having a mounting surface engageable with the first surface of the sheet material and a passive surface opposite said mounting surface; and wherein said hook member includes an integral boss element bonded to said passive surface.

5. A hanger system for harmless removable attachment to flexible sheet material having first and second opposed surfaces comprising:

a pair of spaced apart hook members for releasably suspending an article;

a magnetic base member integral with each of said hook members and engageable with the first surface of the flexible sheet material;

a ferrous backing member engageable with the second surface of the flexible sheet material and generally coextensive with each said base member; and a substantially level hanger rod extending between eyelet means engageable, respectively, with said hook members for releasably supporting said hanger rod on the flexible sheet material;

whereby said base member and said backing member for each of said hook members are drawn together by the magnetic flux and held firmly but removably in engagement with the flexible sheet material in a sandwiched relationship; and whereby said hanger rod provides an elongated surface from which one or more articles may be suspended.

6. A hanger system as set forth in claim 5 wherein said hanger rod includes:

first and second rod elements in slidable telescoping engagement, said eyelet means being integral with a free end of each of said first and second rod elements.

7. A hanger system for harmless removable attachment to flexible sheet material having first and second opposed surfaces comprising:

first and second spaced apart hanger devices, each said hanger device including:

a hook member for releasably suspending an article;

a magnetic base member integral with said hook member and engageable with the first surface of the flexible sheet material; and a ferrous backing member engageable with the second surface of the flexible sheet material and generally coextensive with said base member;

whereby said base member and said backing member are drawn together by the magnetic flux and held firmly but removably in engagement with the flexible sheet material in a sandwiched relationship;

said first and second hanger devices lying generally in a level plane; and a substantially level hanger rod extending between eyelet means engageable, respectively, with said hanger devices for releasably supporting said hanger rod on the flexible sheet material;

whereby said hanger rod provides an elongated surface from which one or more articles may be suspended.

8. A hanger system as set forth in claim 7 wherein said hanger rod includes:

first and second rod elements in slidable telescoping engagement, said eyelet means being integral with a free end of each of said first and second rod elements.

* * * * *